350-376
3/4/86 XR 4,574,281 SR

United States Patent [19]
Moriguchi et al.

[11] Patent Number: 4,574,281
[45] Date of Patent: Mar. 4, 1986

[54] IMAGE DISPLAY DEVICE

[75] Inventors: Haruhiko Moriguchi; Yoshiki Kikuchi; Takashi Ohmori, all of Kanagawa, Japan

[73] Assignee: Fuji Xerox Co., Ltd., Tokyo, Japan

[21] Appl. No.: 401,045

[22] Filed: Jul. 22, 1982

[30] Foreign Application Priority Data

Jul. 24, 1981 [JP] Japan ..... 56-115167

[51] Int. Cl.[4] ..... G09G 3/00
[52] U.S. Cl. ..... 340/783; 340/786; 350/376
[58] Field of Search ..... 340/806, 783, 809, 798, 340/786, 713, 714; 369/104, 110, 154; 350/375, 376, 378, 373, 374, 388, 403

[56] References Cited

U.S. PATENT DOCUMENTS

| | | | |
|---|---|---|---|
| 3,195,110 | 7/1965 | Nail | 369/110 |
| 3,438,022 | 4/1969 | Teeg et al. | 340/786 |
| 3,512,866 | 5/1970 | Griffiths et al. | 350/376 |
| 3,541,577 | 11/1970 | Lemke | 350/376 |
| 3,965,461 | 6/1976 | Wreede et al. | 369/154 |
| 4,040,047 | 8/1977 | Hareng et al. | 340/786 |
| 4,088,400 | 5/1978 | Assouline et al. | 350/388 |
| 4,170,772 | 10/1979 | Bly | 350/374 |
| 4,309,084 | 1/1982 | Hill | 350/403 |
| 4,442,429 | 4/1984 | Kotani et al. | 340/786 |

*Primary Examiner*—Gerald L. Brigance
*Attorney, Agent, or Firm*—Sughrue, Mion, Zinn, Macpeak, and Seas

[57] ABSTRACT

An image displaying device uses a thermal head to selectively create a magnetization pattern on an endless belt magnetic recording medium according to a signal applied thereto by heating the magnetic recording medium to its Curie temperature. Polarized light is then passed through or reflected from the belt and fed to an analyzer to obtain an image.

8 Claims, 7 Drawing Figures

IMAGE DISPLAY DEVICE

BACKGROUND OF THE INVENTION

This invention relates to an image display device which operates to convert electrical signals into visible images, to display the visible images thus obtained, and to erase the images thus displayed.

Heretofore, cathode ray tubes or LED (light emitting diode) arrays have been generally employed for image display devices. Among these light emitting elements, only cathode ray tubes have been used for large area image display devices. However, the use of the cathode ray tube is disadvantageous in that the tube is large in size and weight, is high in cost, and requires a high drive voltage.

SUMMARY OF THE INVENTION

Accordingly, an object of this invention is to provide an image display device of small size and of low manufacturing cost which can continuously output images of originals.

The foregoing object of the invention has been achieved by the provision of an image display device in which, according to the invention, polarized light is applied to a magnetization distribution formed on the magnetic recording medium of a magnetic film belt, and the magnetization distribution is converted into a visible image using an analyzer.

BRIEF DESCRIPTION OF THE DRAWINGS

The invention will be described with reference to the preferred embodiments thereof as shown in the accompanying drawings, in which.

DETAILED DESCRIPTION OF THE PREFERRED EMBODIMENTS

Figure 1:
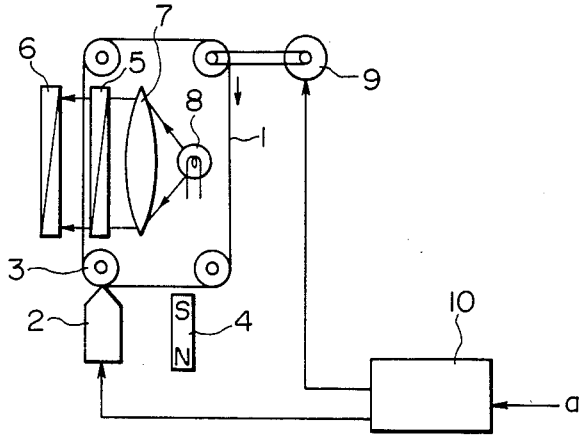
FIG. 1 is an explanatory diagram outlining a first embodiment of this invention.
Figure 2:
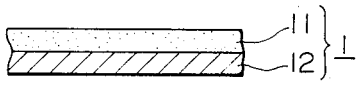
FIG. 2 is a sectional view of a magnetic film belt of FIG. 1.

FIG. 1 is an explanatory diagram outlining a first embodiment of the invention. FIG. 2 is a sectional view of a magnetic film belt thereof; and FIGS. 3(A)-3(D) are diagrams for describing the effect of partial heating on the magnetic recording medium of the magnetic film belt, whereby the magnetization conditions thereof are changed to record an image.

In these drawings, reference numeral 1 designates a magnetic film belt which is used as a photo-magnetic memory medium. The magnetic film belt 1 is made up two layers; a magnetic recording medium 11 and a transparent support 12. The magnetic recording medium 11 is made of a Gd.Tb.Fe non-crystalline magnetic film. Further in the figures, reference numeral 2 designates a thermal head; 3, a rubber roll; and 4, a bias magnetic field generator for uniformly magnetizing the magnetic recording medium 11.

Further, reference numeral 5 designates a polarizer; 6, an analyzer; 7, a lens; 8, a light source; 9 a motor; 10, a control circuit for controlling the thermal head 2 and the motor 9; and a, an input video signal.

Figure 3A:
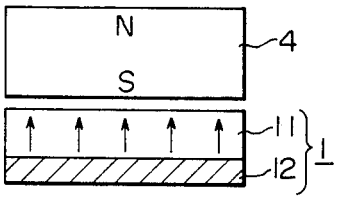
FIGS. 3(A)-3(D) are diagrams for describing the principles of magnetic image formation according to the invention.
Figure 3B:
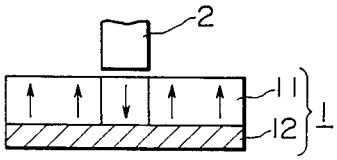
Figure 3C:
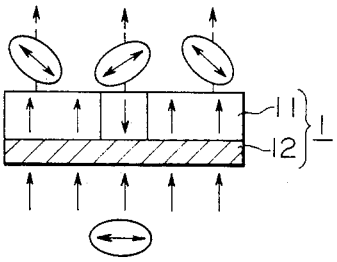

Firstly, the magnetic film belt 1 is run by means of the motor 9, so that the magnetic recording medium 11 of the belt 1 is uniformly magnetized by the bias magnetic field generator 4 (FIG. 3(A)).

Next, according to the input video signal a, the magnetic recording medium 11 is partially and selectively heated to a temperature close to the Curie point or compensation point, so that the portion thus heated is demagnetized. During coooling, the direction of magnetization of the portion is reversed by the effect of the magnetic field of the adjacent portions (not heated) (FIG. 3(B)).

Thus, a magnetization distribution "image" corresponding to the input video signal a is obtained on the magnetic recording medium 11.

Thereafter, the magnetization distribution on the magnetic recording medium 11 is converted into an optical signal by the utilization of the magnetic Kerr effect (or the magnetic Faraday effect). For this purpose, light from the light source 8 is applied to the lens 7 and the polarizer 5 to obtain polarized light, and the polarized light thus obtained is applied to the magnetic film 1. In this operation, the polarization planes of the passed light beams are changed according to the magnetization directions provided by the thermal head 2, because of the magnetic Kerr effect (or the magnetic Faraday effect) (FIG. 3(C)).

Therefore, if the polarization plane of the analyzer is made coincident with one of the polarization planes of the passed light beams, a light and shade image according to the magnetization distribution can be obtained.

As is apparent from the above description, according to the invention, the thermal head 2 is used to form a thermal distribution on the magnetic recording medium 11 of the magnetic film belt 1 according to the input video signal a, to thereby obtain a light and shade image corresponding thereto. It goes without saying that, in this case, it is unnecessary for the support forming the magnetic recording belt to be transparent.

Figure 4:
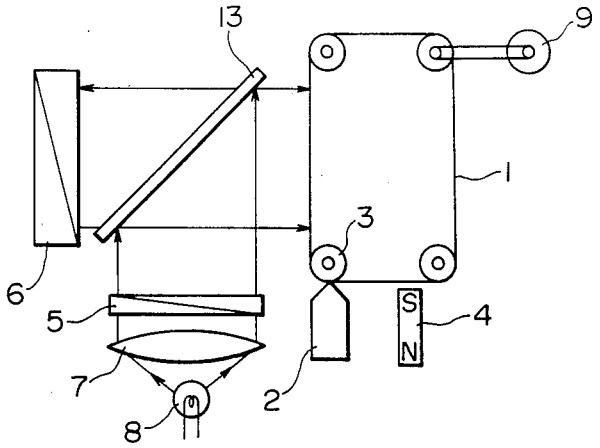
FIG. 4 is a diagram outlining a second embodiment of the invention.

In a second embodiment of the invention, a half-mirror 13 is employed as shown in FIG. 4, so that the reflected image of an original can be read using the light source 8 set outside of the magnetic film belt 1.

In both the first and second embodiments of the invention, the magnetic film belt employed is made of a polyimide or polyester film and a Gd.Tb.Fe noncrystalline magnetic film (Curie temperature $T_c=165°$ C., coercive force $H_c=1.2$ K/Oe and magnetic Kerr rotation angle Ok=0.4), in the form of double layers.

A thick film resistance thermal head having a width of 210 mm and a recording density of 8 dots/mm was used as the thermal head.

Under the following driving conditions, the period of time required for displaying the data on a sheet of A4 size was about 15 seconds, and an excellent light and shade image was projected on the screen:

Applied pulse width=2 to 3 millisecond

Applied electric power=0.6 watt/dot

Process speed=5 to 10 ms/line

When, in the first or second embodiment, the magnetic recording medium 11 runs while being directly pressed against the thermal head 2, mechanical friction is increased. In order to eliminate this drawback, a method may be employed in which the transparent support 12 is pressed directly against the thermal head 2 so that the magnetic film belt is heated from the side of the transparent support.

Figure 3D:
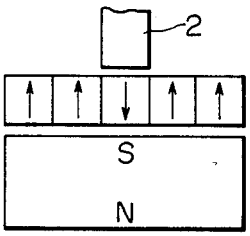

The magnetizaed image can be more positively formed by applying a bias magnetic field to that portion heated by the thermal head 2, as shown in FIG. 3(D). The image may be formed on a projecting board.

The analyzer 6 may of any type as long as it can detect a polarization angle distribution. It goes without saying that the analyzer may be of the transparent type or of the reflection type.

In the above-described embodiment, the apparatus for forming a magnetization distribution image on the magnetic recording medium with the thermal head has the particular construction as described above. However, it should be noted that, in general, the invention can employ a magnetization distribution image forming means in which, by selectively and locally heating a magnetic recording medium having a uniform magnetization pattern (including demagnetization conditions), the magnetization pattern of the heated portion is made different from that of the remaining portions.

More specifically, any of the following means can be employed.

(1) In pretreatment before a recording operation, magnetization is uniformly effected in the surface of the magnetic recording medium, and a bias magnetic field is later applied in a direction different from the direction of magnetization.

(2) In pretreatment before a recording operation, the magnetic recording medium is demagnetized, and then only the heated portion is magnetized in a predetermined direction by a bias magnetic field.

(3) In pretreatment before a recording operation, the magnetic recording medium is uniformly magnetized and is locally and selectively heated, so that the portion so heated is re-magnetized without using a bias magnetic field.

As is clear from the above description, in the invention, polarized light is applied to a magnetization pattern image which is formed on the magnetic recording medium of the magnetic film belt, and the magnetization image is converted into a visible image with the aid of the analyzer. Therefore, the image display device according to the invention is advantageout in that it is small in size and low in cost and can continuously provide the images of input video signals.

What is claimed is:

1. An image display device, comprising:

a magnetic film belt including a magnetizable recording medium, a thermal head for selectively and locally heating desired portions of said recording medium to a temperature close to the Curie point or compensation point in response to a video signal to form a magnetization distribution on said recording medium, a light source, a polarizer for polarizing light from said light source, means for applying said light thus polarized to said magnetic film belt, an analyzer arranged in the optical path of light output from said belt for obtaining an image corresponding to said video signal, and means for moving said belt past said thermal head and to said applying means.

2. An image display device as claimed in claim 1, said analyzer receiving light passed through said belt.

3. An image display device as claimed in claim 1, said analyzer receiving light reflected from said belt.

4. An image display device as claimed in claim 1, further including means for uniformly magnetizing said recording medium prior to introduction to said thermal head.

5. An image display device as claimed in claim 1, further including means for demagnetizing said recording medium prior to introduction to said thermal head.

6. An image display device as claimed in claim 4, including means for applying a bias magnetic field in a direction different from said uniform magnetization.

7. An image display device as claimed in claim 5, including means for applying a bias magnetic field for magnetizing only a heated portion of said recording medium in a predetermined direction.

8. An image display device as claimed in claim 3, including a half mirror for reflecting said polarized light onto said magnetic film belt.

* * * * *